United States Patent [19]

Wagner

[11] Patent Number: 4,465,023

[45] Date of Patent: Aug. 14, 1984

[54] PROGRAMMED COMBUSTION STEAM GENERATOR

[75] Inventor: William R. Wagner, Los Angeles, Calif.

[73] Assignee: Rockwell International Corporation, El Segundo, Calif.

[21] Appl. No.: 432,178

[22] Filed: Sep. 30, 1982

[51] Int. Cl.[3] ..... F22B 37/00

[52] U.S. Cl. ..... 122/6 A; 122/235 A; 122/235 B; 166/59; 431/158

[58] Field of Search ..... 122/6 A, 4 R, 13 R, 122/235 A, 235 B; 431/158, 10; 166/59

[56] References Cited

U.S. PATENT DOCUMENTS 4,289,474 9/1981 Honda et al. ..... 431/10

4,385,661 5/1983 Fox ..... 431/158 X

*Primary Examiner*—Edward G. Favors

*Attorney, Agent, or Firm*—H. Fredrick Hamann; Harry B. Field

[57] ABSTRACT

The present invention provides a steam generator which comprises rocket-type multielement injector head and a small diameter, highly elongated, cylindrical combustion chamber whose walls are formed from a plurality of longitudinally adjoined water tubes. The multielement injector head injects an array of associating streams of fuel and oxidizer into the combustion chamber under sufficient pressure to maintain a combustion pressure in the range of 25–150 psia whereupon the narrowness of the combustion chamber serves to constrict the resultant combustion gases to thereby promote radiant and convective heat transfer from the flame of combustion through the walls of the combustion chamber into the water passing through the water tubes. By such arrangement the production of nitrogen oxides in the combustion chamber is avoided.

20 Claims, 10 Drawing Figures

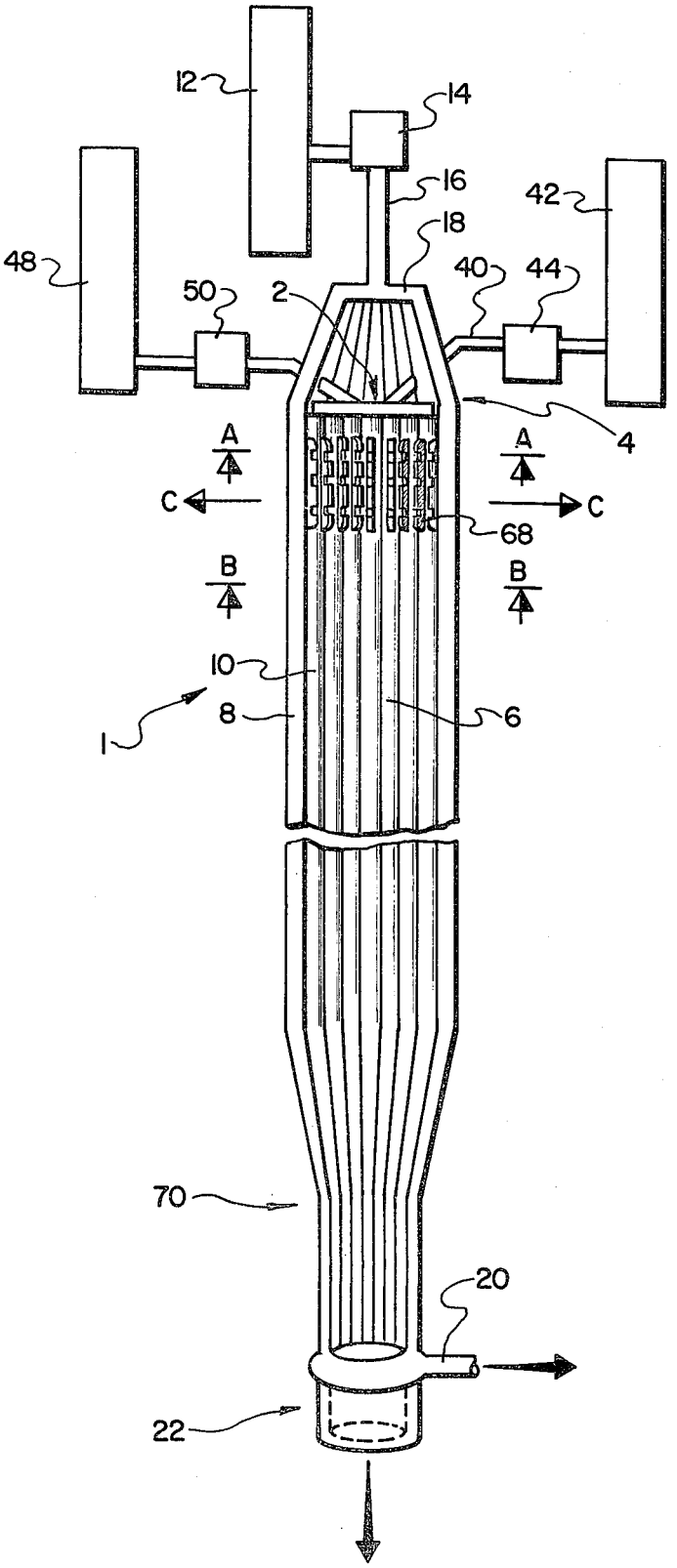
Fig. 1.
Fig. 1.a.
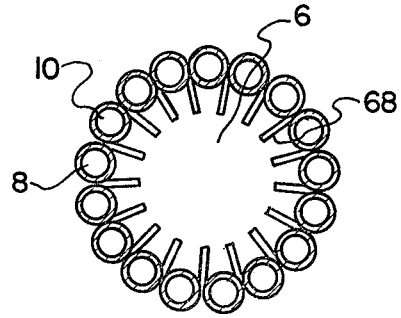
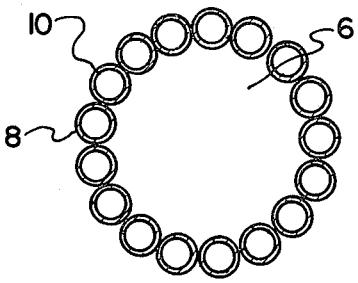
Fig. 1.b.
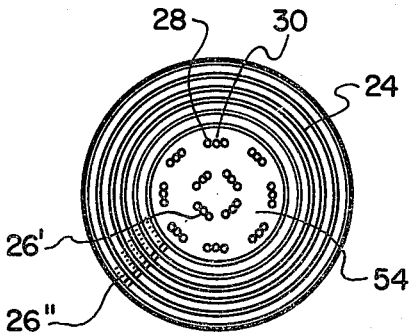
Fig. 1.c.
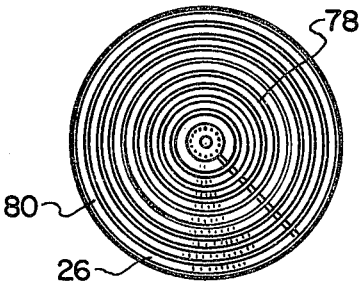
Fig. 1.d.

Fig. 2.a.
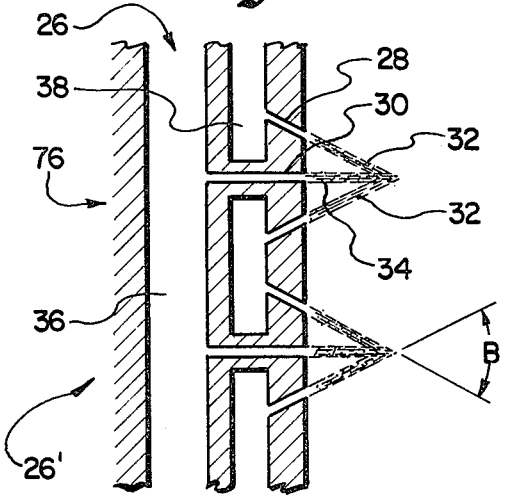
Fig. 2.b.
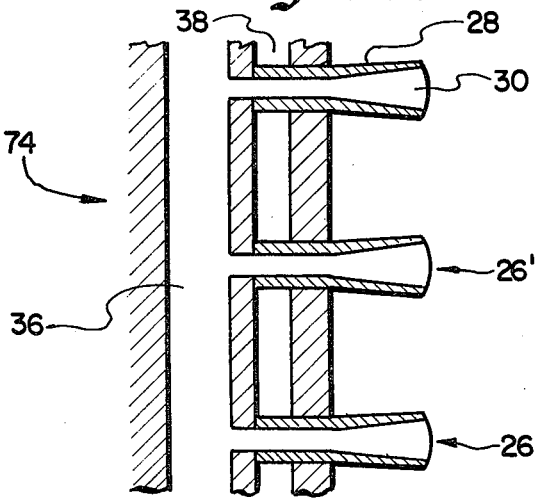
Fig. 3.
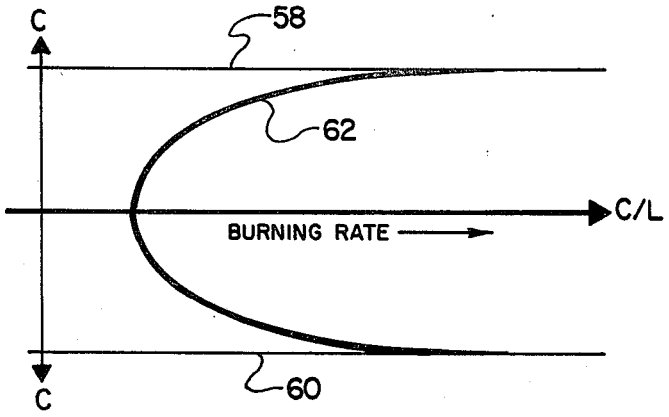
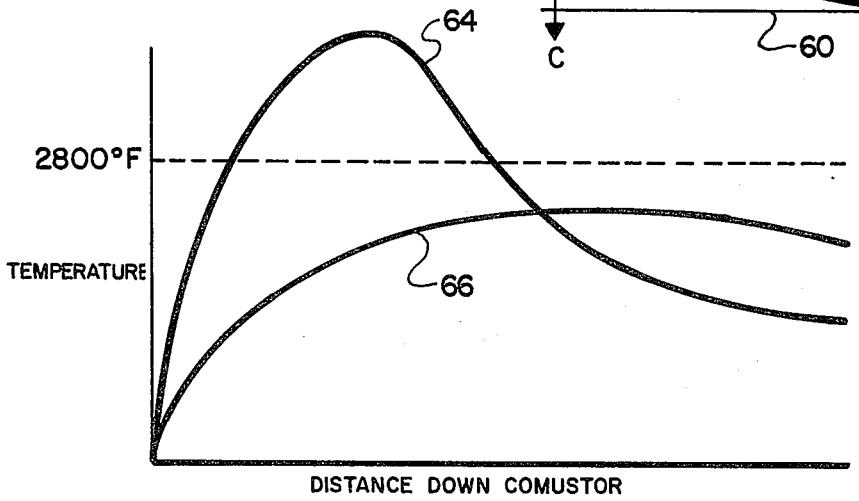
Fig. 4.
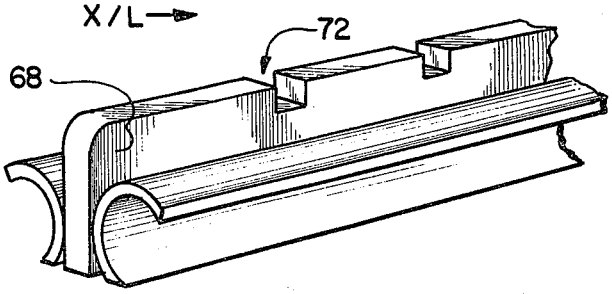
Fig. 5.

PROGRAMMED COMBUSTION STEAM GENERATOR

FIELD OF THE INVENTION

The present invention relates generally to combustors for boilers and steam generators and more particularly, to combustors for steam generators which include means for controlling nitrogen oxide emissions.

BACKGROUND AND DESCRIPTION OF THE PRIOR ART

It would take the likes of a Carl Sagan to utter a number large enough to represent the amount of steam generated each day for industrial and other commercial purposes throughout the world. All this sounds heartening at first, until it is realized that a good part, if not all of this steam is generated in boilers or steam generators which create large volumes of air pollutants, particularly, carbon monoxide, unburnt hydrocarbons and nitrogen oxides. The generation of these pollutants and the existence of stringent air quality standards, especially with respect to the nitrogen oxides, have required operators of steam generators to take measures for cleansing these pollutants from their systems' exhaust. These measures often require quite costly and complicated machinery.

The taking of such post-combustion measures ignores the real source of the problem—the combustor. The normal combustor or furnace device operates at low static pressure (1 psig) and uses a relatively large chamber to maintain therein one or more ball-shaped flames in steady state condition. Because the flame is not allowed any significant degree of convection from one spatial location to another, thermal striations develop in the flame wherein there exists a high temperature central core surrounded by a cooler exterior envelope of combusting gas. The hot core most often exceeds the critical temperature required for the production of nitrogen oxides (approximately 2800° F.). Also, the temperatures of the gases surrounding the core are too low for complete combustion. These peripheral cooler gases cause the flame to emit carbon monoxide and incompletely combusted hydrocarbons in addition to the nitrogen oxides generated at the hot core of the flame.

There is the downhole steam generator described in U.S. Pat. No. 4,243,098 to Meeks et al. which seems to depart from the usual design for steam generators, but which nonetheless exhibits the same shortcomings. In Meeks et al, a combustor comprising a combustion chamber and a single nozzle is used as a source of heated gas for purposes of generating steam at the base of a petroleum well hole. However, there is shown in FIG. 1 a single, elongated ball-flame and it is stated therein that the heated gases initially attain a temperature of approximately 3200° F., a temperature well above the critical temperature where nitrogen oxides being forming.

OBJECTS OF THE PRESENT INVENTION

It is therefore an immediate object of the present invention to provide a combustor suitable for use in a steam generator which burns fuel more completely without producing nitrogen oxides.

It is another object of the present invention to provide a steam generator which does not require treatment of its exhaust gases for purposes of controlling nitrogen oxides and other pollutants.

SUMMARY OF THE INVENTION

The present invention achieves these and other objects by providing a steam generator which comprises rocket-type multielement injector head and a small diameter, highly elongated, cylindrical combustion chamber whose walls are formed from a plurality of longitudinally adjoined water tubes. The multielement injector head injects an array of associating streams of fuel and oxidizer into the combustion chamber under sufficient pressure to maintain a combustion pressure in the range of 25–150 psia whereupon the narrowness of the combustion chamber serves to constrict the resultant combustion gases to thereby promote radiant and convective heat transfer from the flame of combustion through the walls of the combustion chamber into the water passing through the water tubes. The array of associating streams of fuel and oxidizer is patterned to create a burning-rate profile which results in the progression of combustion in discrete stages along the entire length of the combustion chamber. The graduated release of combustion heat is taken up by the flow of water at a rate which balances the rate of heat generated in the combustion chamber so that the combusting gases therein remain at a low enough temperature to avoid production of substantial quantities of nitrogen oxides. The invention also provides longitudinally oriented fins at the inlet of the combustion chamber for increasing the rate of heat transfer where heat generation and temperature would be expected to peak.

BRIEF DESCRIPTION OF THE DRAWINGS

The same elements or parts throughout the figures of the drawing are designed by the same reference characters, while equivalent elements bear a prime designation.

FIG. 1 is a longitudinal-sectional view of a steam generator constructed according to the preferred embodiment of the present invention.

FIG. 1*a.* is a cross-sectional view taken at line A—A in FIG. 1.

FIG. 1*b.* is a cross-sectional view taken at line B—B in FIG. 1.

FIG. 1*c.* is a frontal view of the injector plate of the embodiment shown in FIG. 1.

FIG. 1*d.* is a frontal view of an alternative injector plate for use in the embodiment shown in FIG. 1.

FIG. 2*a.* is a sectional side-view of a pair of impinging-type injector elements housed in the injector plate of FIG. 1*c.*

FIG. 2*b.* is a sectional side-view of concentric-type injector elements housed in the injector plate of FIG. 1*c.*

FIG. 3 is a graphical representation of the burning rate profile produced by the injector plate of FIG. 1*c.*

FIG. 4 is a comparative graphical representation of the temperature lines of prior art devices and the present invention.

FIG. 5 is a detail view of the fins appearing at the inlet end of the combustion chamber of the embodiment shown in FIG. 1.

DETAILED DESCRIPTION OF THE PREFERRED EMBODIMENT

Other objects, advantages and novel features of the present invention will become apparent from the following detailed description of the invention when considered in conjunction with the accompanying drawing.

Referring to FIG. 1, 1*a.*, 1*b.* and 1*c.* the preferred embodiment of the present invention provides a steam generator generally designated 1 and comprising a rocket-type multielement injector assembly 2 situated at inlet end 4 of a narrow, extremely elongated cylindrical combustion chamber 6. Walls 8 of combustion chamber 6 are preferably constructed from a plurality of longitudinally adjoined tubes 10 constructed of thermally conductive material. Combustion chamber 6 preferably has a length of at least 25 times greater than its width, and a typical operational version might have a diameter of approximately six inches and length of thirty feet or more. A flow of water from tank 12 and pump 14 travels down line 16 to header 18 from whence it enters tubes 10 at the inlet end 4 of combustion chamber 6. As the flow of water travels through tubes 10 to manifold 20 at outlet end 22 of the combustion chamber 6, the water absorbs the heat transferred from combustion chamber 6 through walls 8 and turns into useable steam.

Referring to FIG. 1, 1*c.*, 2*a.* and 2*b.*, multielement injector assembly 2 comprises a circular injector plate 24 for housing a plurality of individual injector elements 26 in an arrayed-pattern typically found in rocket-type injector plates. Each individual injector element 26 comprises at least one fuel orifice 28 and at least one oxidizer orifice 30 which emit associating streams of fuel and oxidizer, respectively. It is to be understood that the term "associating streams" herein refers to both the fuel jetlet(s) 32 and oxidizer jetlet(s) 34 that are emitted from a single individual injector element 26 as well as to the stream of resultant combustion products created by chemical interaction of the jetlets 32 and 34. Injector plate 24 also comprises an oxidizer manifold 36 and a fuel manifold 38 which are constructed in a manner well known to the art and which supply oxidizer and fuel to the respective orifices of each individual injector element 26. A supply of oxidizer is supplied via line 40 to oxidizer manifold 36 from an external tank 42 and pump 44 and fuel is supplied to fuel manifold 38 via line 16 from external tank 42 and pump 44. Preferably, the oxidizer is compressed air and the fuel is fuel oil although other fuels such as diesel fuel, natural gas or a rocket-type fuel might be used instead. The present invention prefers, however, that the selected fuel and oxidizer be injected under sufficient pressure to create a combustion pressure of the range of 25–150 psia so that the narrowness of combustion chamber 6 serves to constrict the combusting gases as they travel from inlet end 4 to outlet end 22 of the combustion chamber. The constrictive effect of combustor walls 8 causes the combustion gases to be in contacting relationship therewith so that heat transfer can be effected through both convection and radiation into walls 8. The narrowness of combustion chamber 6 also serves to substantially increase the intensity of heat radiation from the combusting gases by reason that the radiation beam length of the gases at the central regions of the combustion chamber is shortened so that there is less interference from the surrounding gases.

Besides the constrictive and cooling effects provided by walls 8 to the gases in combustion chamber 6, another important feature of the present invention is the creation of a burning-rate profile across the width of combustion chamber 6 which profile is achieved by the particular arrangement of the individual injector elements 26 on injector plate 24. As is shown in FIG. 1*c.*, face 52 of injector plate 24 comprises an inner circular region 54 which houses individual injector elements 26' which are larger and of a different type than those elements 26'' housed at the peripheral region 56 of face 52. These differences in size and type cause an array of associating streams of fuel and oxidizer to be emitted from injector plate 24 wherein a core of relatively slow combusting gases are surrounded by a sleeve of more rapidly combusting gases. This situation results in a burning-rate profile as depicted in FIG. 3 wherein the vertical line C—C corresponds to line C—C in FIG. 1 to represent radial displacement above and below the axial centerline of combustion chamber 6. The centerline of combustion chamber 6 is represented by the line labled C/L and lines 58 and 60 represents the boundaries of walls 8 of combustion chamber 6. The line labled C/L also serves to represent increasing burning rate in the direction of the arrowhead and the curved line gives indication of the preferred burning-rate profile to be achieved by injector plate 24. In accordance with the preferred burning-rate profile, associating streams of fuel and oxidizer from peripheral region 56 of injector plate 24 are to burn at a more rapid rate than those from inner circular region 54. As a result, the combustion process progresses in indiscrete stages along the entire length of combustion chamber 6 as more and more of the core region of the combusting gas begins to burn. This delayed effect causes the heat released from the combustion process to be similarly smeared-out or graduated, which situation in turn allows for the rate of heat generation from the combusting gases at any given length segment of combustion chamber 6 to be matched by the rate of heat transferred to the flow of water passing through tubes 10 so that the combusting gases never attain a temperature where substantial quantities of nitrogen oxides are produced. This avoidance of nitrogen oxide producing temperatures can be further understood by reference to FIG. 4 wherein line 64 represents a temperature line along the length of a typical combustion chamber of the prior art wherein a ball-flame is introduced into a combustion chamber which does not confine the flame. As is shown line 64 peaks at a temperature above that where nitrogen oxides being to form (approximately 2800° F.). However, the temperature line 66 of the present invention peaks below the threshold temperature.

It is also to be understood the heat extraction by the water flow through tubes 10 helps achieve these favorable results in two ways: by removing heat from combustion chamber 6 at a rate which avoids local overheating within the combusting gases; and by removing heat at a rate which prolongs the delayed combustion process initiated by the burning-rate profile. The ultimate result is that steam is generated in tubes 10 while fuel is combusted completely in combustion chamber 6, but without the production of significant quantities of nitrogen oxides.

Referring to FIGS. 1 and 5, the practice of the present invention might require the additional of longitudinally oriented fins 68 be added to walls 8 along segments of combustion chamber 6 where the temperature of combusting gases would be expected to be highest. These fins serve to increase thermal transfer to walls 8 so that the undesired threshold temperature is avoided. A shown in FIG. 1, fins 68 are likely needed at the inlet end 4 and might also prove necessary at the beginning of a constriction 70 in combustion chamber 6. Such constrictions serve to increase mixing of the combusting gases at selected down-range locations along combustion chamber 6 and are therefore locations where temperatures can be expected to jump. It is to be noted that fins 68 have notches 72 at points along their length to intermittently upset boundary layers which might otherwise form thereon and lessen their thermal conductivity.

Referring back to FIGS. 1*c.* 2*a.* and 2*b.*, it is preferred that the individual injector elements 26' situated at inner circular region 54 of injector face 52 serve to emit a core of associating streams of fuel and oxidizer which combusts at rate slower than those streams emitted from injectors 26' at peripheral region 56. As previously mentioned, this result can be achieved by making individual injector elements 26' larger and of a different type from elements 26''. In terms of type, it is preferred that injector elements 26' be of the coaxial type as is shown in FIG. 2*b.* wherein central jetlets 34 of oxidizer are encased with associating jetlets 32 of fuel. Impinging-type injector elements 76 as shown in FIG. 2*a.* could also be used, but with an angle of impingement (B) which is smaller than that of similar types to be used as injector elements in peripheral region 56 of injector face 52. The small angle of impingement delays mixing of the associating streams and thus their combustion.

Other means can be employed in order to arrive at the desired pattern-array of associating streams of fuel and oxidizer. For instance, injector elements 26' of inner circular region 54 might be less closely packed both in the radial or circumferential manner across injector face 52 than elements 26''. Also, the velocity ratios between oxidizer jetlet 34 and fuel jetlet 32 might be made to impede rapid mixing for injector elements 26' than for elements 26'' at peripiheral region 56, or the fuel/air ratios might be similarly differentiated or any combination of these means for producing the desired burning-rate profile.

FIG. 1*d.* is provided to show an injector face wherein the bounds of inner circular region 54 is less well defined than that of injector face shown in FIG. 1*c.* However, FIG. 1*d.* is more representative of a rocket-type injector plate 24 which might be used in accordance with the present invention. Injector plate 24 comprises 5 to 10' circumferential bands 78 of individual injector elements 26''', the outer band 80 containing approximately 20 of injector elements 26''' for an injector of approximately 6 inches diameter.

It is to be understood that multielement injector assembly 2 is sealingly affixed to walls 8 at input end 4 of combustion chamber 6.

Obviously, many modifications and variations of the present invention are possible in light of the above teachings. For instance, another cooling medium other than water might be applied through tubes 10. It is therefore to be understood that, within the scope of the appended claims, the invention may be practiced otherwise than as specifically described.

What is claimed and desired to be secured by Letters Patent of the United States is:

1. A steam generator comprising:

a highly elongated, cylindrical combustion chamber having thermally conductive walls comprising a plurality of longitudinally adjoined tubes, said combustion chamber having an input end, an output end and interior surfaces;

an injector assembly sealingly affixed to said input end comprising a plurality of individual injector elements arrayed upon a peripheral region and an inner region of an injector plate for injecting under pressure associating streams of fuel and oxidizer into said input end, those injector elements at the peripheral region of said injector plate initiating a more rapid burning rate in the respective association streams than those injector elements at the inner region of said injector plate, so that said injector initiates a combustion process which progresses in discrete stages along the length of said combustion chamber to thereby graduate the heat released from said combustion process;

means for supplying fuel and oxidizer under pressure to said injector assembly; and means for supplying a flow of water through said plurality of tubes from said input end to said output end for extracting heat from said combustion chamber at a rate which matches the heat generation at any given length segment of said combustion chamber so that said combustion process does not attain a temperature where substantial quantities of nitrogen oxides and produced.

2. A steam generator comprising:

a highly elongated, cylindrical combustion chamber having thermally conductive walls comprising a plurality of longitudinally adjoined tubes, said combustion chamber having an input end, an output end and interior surfaces;

an injector assembly sealingly affixed to said input end comprising a plurality of individual injector elements for injecting an array of associating streams of fuel and oxidizer into said input end under sufficient pressure to maintain a combustion pressure throughout said combustion chamber, said array of associated streams of fuel and oxidizer creating a burning rate profile which results in a progression of combustion along the length of said combustion chamber;

means for supplying fuel and oxidizer under pressure to said injector assembly; and means for supplying a flow of water through said plurality of tubes from said input end to said output end for extracting heat from said combustion chamber at a rate which avoids the production of nitrogen oxides and for producing steam, wherein said interior surfaces of said combustion chamber include means locally for increasing the extraction of heat from said combustion chamber so that combustion in said associating streams do not achieve a localized temperature in excess of the threshold temperature for production of nitrogen oxides.

3. The steam generator as claimed in claim 2 wherein said means for selectively increasing said heat transfer includes longitudinally extending fins which extend radially inwardly from said interior surfaces into said combustion chamber.

4. The steam generator as claimed in claim 3 wherein said fins are situated at said inlet end.

5. The steam generator as claimed in claim 3 wherein said fins include means for breaking up boundary layers forming thereon.

6. The steam generator as claimed in claim 5 wherein said means for breaking up boundary layers is at least one notch in each of said fins fins.

7. The steam generator as claimed in claim 3 wherein said multielement injector assembly further comprises a circular injector plate having an inner region and a peripheral region, said injector plate housing a plurality of individual injector elements each comprising an oxidizer orifice and a fuel orifice for emitting impinging jetlets of oxygen and fuel, respectively.

8. The steam generator as claimed in claim 7 wherein the portion of said plurality of injector elements in said inner region are larger than the portion of said plurality of injector elements in said peripheral region.

9. The steam generator as claimed in claim 7 wherein the portion of said plurality of injector elements in said inner region are less closely grouped than the portion of said plurality of injector elements in said peripheral region.

10. The steam generator as claimed in claim 7 wherein the portion of said plurality of injector elements in said inner region are coaxial-types and the portion of said plurality of injector elements in said peripheral region are impinging types.

11. The steam generator as claimed in claim 7 wherein the portion of said plurality of injector elements in said inner region having impingement angles for said jetlets of oxygen and fuel which are a smaller angle than those found in the portion of said plurality of injector elements in said peripheral region.

12. The steam generator as claimed in claim 7 wherein the portion of said plurality of injector elements in said inner region have a fuel/air ratio which is less favorable to mixing than those of the portion of said plurality of injector elements in said peripheral region.

13. The steam generator as claimed in claim 7 wherein the portion of said plurality of injector elements in said inner region have a velocity ratio between said jetlets which is less favorable to mixing than those of the portion of said plurality of injector elements in said peripheral region.

14. The steam generator as claimed in claim 1 wherein those injector elements in said inner region are larger than those injector elements in said peripheral region.

15. The steam generator as claimed in claim 1 wherein those injector elements in said inner region are more closely grouped than those injector elements in said peripheral region.

16. The steam generator as claimed in claim 1 wherein those injector elements in said inner region are coaxial-types and those injector elements in said peripheral region are impinging types.

17. The steam generator as claimed in claim 1 wherein all said injector elements are impinging types, those injector elements in said inner region having impingment angles which are smaller than those found in those injector elements in said peripheral region.

18. The steam generator as claimed in claim 1 wherein those injector elements in said inner region have a fuel/air ratio which is less favorable to mixing than those injector elements in said peripheral region.

19. The steam generator as claimed in claim 1 wherein those injector elements in said inner region have a velocity ratio which is less favorable to mixing that those injector elements in said peripheral region.

20. The steam generator as claimed in claim 1 wherein said interior surfaces of said combustion chamber include fins at at least one location for increasing the extraction of heat from said combustion chamber so that combustion in said associating streams do not achieve a localized temperature in excess of the threshold temperature for production of nitrogen oxides.

* * * * *